US010737280B2

(12) United States Patent
Liu et al.

(10) Patent No.: US 10,737,280 B2
(45) Date of Patent: Aug. 11, 2020

(54) METHOD OF USING FLOTATION COLLECTOR CONTAINING AZOLETHIONE STRUCTURE

(71) Applicant: CENTRAL SOUTH UNIVERSITY, Hunan (CN)

(72) Inventors: Guangyi Liu, Hunan (CN); Yaoguo Huang, Hunan (CN); Longqun Ma, Hunan (CN); Xiaoxue Niu, Hunan (CN); Jun Liu, Hunan (CN); Hong Zhong, Hunan (CN); Zhe Hu, Hunan (CN)

(73) Assignee: CENTRAL SOUTH UNIVERSITY, Hunan (CN)

( * ) Notice: Subject to any disclaimer, the term of this patent is extended or adjusted under 35 U.S.C. 154(b) by 0 days.

(21) Appl. No.: 16/361,156

(22) Filed: Mar. 21, 2019

(65) Prior Publication Data

US 2019/0217310 A1 Jul. 18, 2019

Related U.S. Application Data

(63) Continuation of application No. PCT/CN2016/109394, filed on Dec. 12, 2016.

(30) Foreign Application Priority Data

Sep. 23, 2016 (CN) ..... 2016 1 0846325

(51) Int. Cl.
*B03D 1/02* (2006.01)
*B03D 1/012* (2006.01)

(52) U.S. Cl.
CPC ..... *B03D 1/012* (2013.01); *B03D 1/02* (2013.01); *B03D 2201/02* (2013.01); *B03D 2203/02* (2013.01); *B03D 2203/025* (2013.01)

(58) Field of Classification Search
CPC ..... B03D 1/02; B03D 1/012; B03D 2201/02; B03D 2203/02; B03D 2203/025
(Continued)

(56) References Cited

U.S. PATENT DOCUMENTS 1,801,317 A * 4/1931 Moses ..... B03D 1/012 209/166
1,801,318 A * 4/1931 Moses ..... B03D 1/012 209/166

(Continued)

FOREIGN PATENT DOCUMENTS

| | | |
|---|---|---|
| CN | 104307641 | 1/2015 |
| CN | 106179767 | 12/2016 |
| GB | 2182030 | 5/1987 |

OTHER PUBLICATIONS

Li Zhancai et al., "Synthesis of 2-Mercapto-5-Methyl-1, 3, 4-Thiadiazole", Chemical Research and Application, Jun. 1997 pp. 1-3.

(Continued)

*Primary Examiner* — Thomas M Lithgow
(74) *Attorney, Agent, or Firm* — JCIPRNET

(57) ABSTRACT

The present invention relates to an azolethione flotation collector and application thereof. According to the application, an azolethione compound such as a 1,3,4-thiadiazole-2-thione compound, a 1,3,4-oxadiazole-2-thione compound, a 1,2,4-triazole-3-thione compound or a 1,2,4,5-tetrazole-3-thione compound is used as a mineral flotation collector to be applied to ores containing copper, zinc, lead, nickel, cobalt, platinum, palladium, silver or gold minerals to realize flotation recovery of valuable metal minerals. Compared with common flotation collectors in the existing technologies, the flotation collector of the present invention can (Continued)

effectively improve enrichment and recovery of copper, zinc, lead, nickel, cobalt, platinum, palladium, silver or gold minerals.

20 Claims, 6 Drawing Sheets

(58) Field of Classification Search
USPC ..... 209/166
See application file for complete search history.

(56) References Cited

U.S. PATENT DOCUMENTS 4,511,464 A 4/1985 Bergman
4,605,519 A 8/1986 Bergman

OTHER PUBLICATIONS

Ajoy Saha et al., "Green synthesis of 5-substituted-1,3,4-thiadiazole-2-thiols as new potent nitrification inhibitors", Journal of Heterocyclic Chemistry, Jul. 2010, pp. 838-845.
Yan Li et al., "Stereoselective synthesis and fungicidal activities of (E)-alpha-(methoxyimino)-benzeneacetate derivatives containing 1,3,4-oxadiazole ring.", Bioorganic & medicinal chemistry letters, Feb. 2006, pp. 2278-2282.
Abdel-Rahman Farghaly et al., "Synthesis of some new azoles of potential antiviral activity", Arkivoc, May 2006, pp. 76-90.
Md. A. Rahman et al., "ZnCl2 catalyzed efficient synthesis of 1,3,4-oxadiazole and 1,3,4-thiadiazole", Tetrahedron Letters, Apr. 2014, pp. 3267-3273.
Eric Hoggarth., "251. Compounds related to thiosemicarbazide. Part II. 1-Benzoylthiosemicarbazides", Journal of the Chemical Society, Jan. 1949, pp. 1163-1167.
Refat El-Sayed., "Substituted Thiadiazole, Oxadiazole, Triazole and Triazinone as Antimicrobial and Surface Activity Compounds", J. Surfact Deterg, Jun. 2012, pp. 39-47.
Manjunatha Kumsi et al., "Synthesis of Some Fused Triazole Derivatives Containing 4-Isobutylphenylethyl and 4-Methylthiophenyl Moieties", Verlag der Zeitschrift für Naturforschung, Zeitschrift fur Naturforschung B., Jul. 2010, pp. 1353-1358.
Russo Filippo et al., Abstract of "Benzothiazol-Derivate Von 1,2,4-Triazol", Annali Di Chimica, 1972, pp. 159-160.
M. Gopalakrishnan et al., "Easy-to-execute 'One-pot' Synthesis of 1,2,4,5-Tetrazines Catalyzed by Activated Fly Ash", Journal of the Korean Chemical Society, Jul. 2007, pp. 520-525.
M. Gopalakrishnan et al., "Design, 'one-pot' synthesis, characterization, antibacterial and antifungal activities of novel 6-aryl-1,2,4,5-tetrazinan-3-thiones in dry media", Journal of Sulfur Chemistry, Aug. 2007, pp. 383-392.
Hasan I. Tashtoush et al., "Dual behavior of monothiocarbohydrazones in the cyclization with diethyl acetylene dicarboxylate (DEAD): synthesis of substituted 1,3-thiazolidin-4-ones", Journal of Sulfur Chemistry, Aug. 2011, pp. 405-412.
Sartaj Tabassum et al., "Synthesis of Aryl-1,2,4,5-tetrazinane-3-thiones, in vitro DNA binding studies, nuclease activity and its antimicrobial activity", Journal of Molecular Structure, Mar. 2012, pp. 33-40.
Mohammad Hossein Mashhadizadeh et al., "Copper(II) modified carbon paste electrodes based on self-assembled mercapto compounds-gold-nanoparticle", Talanta, Feb. 2008, pp. 497-502.
Palanisamy Kannan et al., "Synthesis of mercaptothiadiazole-functionalized gold nanoparticles and their self-assembly on Au substrates", Nanotechnology, Feb. 2008, pp. 1-11.
Futoshi Matsumoto et al., "Studies on the Adsorption Behavior of 2,5-Dimercapto-1,3,4-thiadiazole and 2-Mercapto-5-methyl-1,3,4-thiadiazole at Gold and Copper Electrode Surfaces", Langmuir, Jan. 1999, pp. 857-865.
Orlin L. Blajiev et al., "Potentiodynamic EIS investigation of the 2-methyl-5-mercapto-1,3,4-thiadiazole adsorption on copper", Electrochimica Acta., Jan. 2008, pp. 7451-7459.
Jie Shang et al., "A new 3D Cu(I) coordination polymer with 4-connected umv topological network", Inorganic Chemistry Communications., May 2012, pp. 190-192.
N.K. Singh et al., "Synthesis and X-ray crystallographic studies of Ni (II) and Cu (II) complexes of [5-(4-pyridyl)-1,3,4]oxadiazole-2-thione/thiol formed by transformation of N-(pyridine-4-carbonyl)-hydrazine carbodithioate in the presence of ethylenediamine", Polyhedron, May 2009, pp. 2443-2449.
Kadhim H et al., "Synthesis of 1,3,4-mercapto-oxadiazole mono- and dinuclear copper(I) and copper(II) complexes and their microbiological activity", Transition metal chemistry, May 2004, pp. 804-811.
Kalagouda Gudasi et al., "Transition metal complexes with a new tridentate ligand, 5-[6-(5-mercapto-1,3,4-oxadiazol-2-yl)pyridin-2-yl]-1,3,4-oxadiazole-2-thiol", J. Serb. Chem. Soc., Jul. 2006, pp. 357-366.
Joseph Raj Xavier et al., "Corrosion inhibitive properties and electrochemical adsorption behaviour of some piperidine derivatives on brass in natural sea water", Journal of Solid State Electrochemistry, Apr. 2011, pp. 391-402.
B. Singh et al., "Transition metal complexes of 3-(4-pyridyl)-triazoline-5-thione", Journal of Inorganic and Nuclear Chemistry, Nov. 1972, pp. 3449-3454.
Andrea Scozzafava et al., "Complexes With Biologically Active Ligands. Part 11. Synthesis and Carbonic Anhydrase Inhibitory Activity of Metal Complexes of 4,5-Disubstituted-3-Mercapto-1,2,4-Triazole Derivatives", Metal-based drugs, Dec. 1997, pp. 11-18.
Barbara Pergolese et al., "Study by SERS spectroscopy of the adsorption of 1H-1,2,4-triazole-3-thione on silver sols", Journal of Molecular Structure, Oct. 2002, pp. 349-352.
Heinrich Nöth et al., "The Molecular Structure of Some Transition-Metal Complexes with 1,2,3,4-Tetrazole-5-thiolate Anions", European Journal of Inorganic Chemistry, Aug. 1997, pp. 93-99.
Sadaf Khan et al., "Inhibition of carbon steel corrosion by azathione derivatives in organic acid solutions", Anti-Corrosion Methods and Materials, May 2009, pp. 145-153.
Guangyi Liu et al., "Understanding the hydrophobic mechanism of 3-hexyl-4-amino-1, 2,4-triazole-5-thione to malachite by ToF-SIMS, XPS, FTIR, contact angle, zeta potential and micro-flotation", Colloids and Surfaces A: Physicochem. Eng. Aspects., vol. 503, May 2016, pp. 34-42.

* cited by examiner

METHOD OF USING FLOTATION COLLECTOR CONTAINING AZOLETHIONE STRUCTURE

CROSS-REFERENCE TO RELATED APPLICATION

This application is a continuation of international PCT application serial no. PCT/CN2016/109394, filed on Dec. 12, 2016, which claims the priority benefit of Chinese application no. 201610846325.0, filed on Sep. 23, 2016. The entirety of each of the above-mentioned patent applications is hereby incorporated by reference herein and made a part of this specification.

BACKGROUND

Technical Field

The invention belongs to the field of metal mineral beneficiation and particularly relates to application of a flotation collector containing an azolethione structure.

Description of Related Art

An azolethione compound such as a 1,3,4-thiadiazole-2-thione compound, a 1,3,4-oxadiazole-2-thione compound, a 1,2,4-triazole-3-thione compound or a 1,2,4,5-tetrazole-3-thione compound contains N and S atoms with a stronger coordination ability, so that the azolethione compound can be used as a ligand to be chelated with metal ions such as copper ions and silver ions to serve as a metal corrosion inhibitor. In addition, the azolethione compounds generally have biological activity and are widely used as herbicides, insectifuges, plant growth regulators, fungicides, anti-inflammatory agents, and the like.

The azolethione compounds can be prepared according to synthetic methods reported in literatures.

A common synthetic route for a 1,3,4-thiadiazole-2-thione compound is shown in reaction formula 1.

(Reaction formula 1)

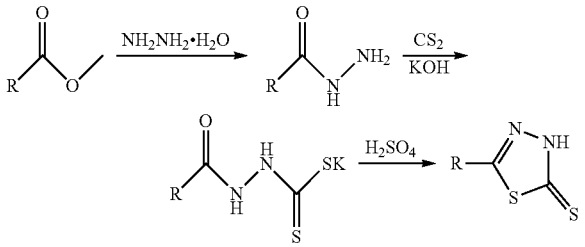

A 1,3,4-thiadiazole-2-thione compound is synthesized through three steps according to this route. First, a hydrazide compound is prepared, then, the hydrazide compound reacts with carbon disulfide and alkali to prepare organic amidodithiocarbamate, and finally, the prepared organic amidodithiocarbamate is subjected to low-temperature cyclization in the presence of concentrated sulfuric acid to obtain the 1,3,4-thiadiazole-2-thione compound. (Li Zhancai, Li Shumian, Fang Shaoming, Hou Shoujun, Nie Xiaobing, Lin Ye. Synthesis of 2-mercapto-5-methyl-1,3,4-thiadiazole [J]. Chemical Research and Application. 1997, 9(5): 521-523; Saha A, Kumar R, Kumar R, et al. Green synthesis of 5-substituted-1, 3, 4-thiadiazole-2-thiols as new potent nitrification inhibitors[J], Journal of Heterocyclic Chemistry, 2010, 47(4): 838-845.)

1,3,4-oxadiazole-2-thione is mainly prepared by taking hydrazide as a raw material and performing reflux reaction with KOH and $CS_2$ in a suitable solvent (as shown in reaction formula 2).

(Reaction formula 2)

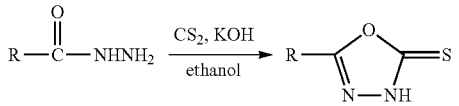

Li et al. take substituent-containing aromatic hydrazide, $CS_2$ and KOH as raw materials, take ethanol as a solvent, and perform reflux reaction for 8 h to prepare 5-phenyl-1, 3,4-oxadiazole-2-thione. (Y. Li, J. Liu, H. Zhang, et al. Stereoselective synthesis and fungicidal activities of (E)-a-(methoxyimino)-benzeneacetate derivatives containing 1, 3, 4-oxadiazole ring[J]. Bioorganic & medicinal chemistry letters, 2006, 16(8): 2278-2282.) Farghaly and El-Kashef take pyridine as a solvent, enable hydrazide and $CS_2$ to be subjected to direct reaction, and perform heating reflux to prepare 1,3,4-oxadiazole-2-thione. (A. R. Farghaly, H. El-Kashef. Synthesis of some new azoles with antiviral potential[J]. Arkivoc, 2006, 11: 76-90.) In addition, Rahman et al. convert hydrazide dithiocarbamate to corresponding 1,3,4-oxadiazole-2-thione under the action of $ZnCl_2$ (as shown in reaction formula 3). (M. A. Rahman, M. R. Karim, M. Arifuzzaman, et al. $ZnCl_2$ catalyzed efficient synthesis of 1, 3, 4-oxadiazole and 1, 3, 4-thiadiazole[J]. Tetrahedron Letters, 2014, 55(21): 3267-3273.)

(Reaction formula 3)

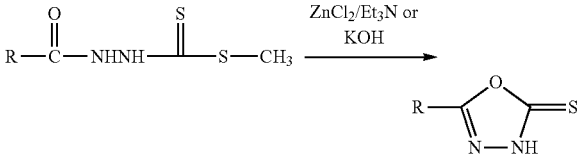

The 1,2,4-triazole-3-thione compound is mainly synthesized by performing heating reflux and cyclization on acylthiosemicarbazide in an alkaline medium. Hoggarth refluxes aroylthiosemicarbazide in an ethanol solution of sodium alkoxide, and then performs acidification to synthesize a 5-substituted aryl-1,2,4-triazole-3-thione compound. (Hoggarth E. Compounds related to thiosemicarbazide. Part II. 1-Benzoylthiosemicarbazides[J]. Journal of the Chemical Society, 1949: 1163-1167.) El-Sayed performs heating reflux on acylthiosemicarbazide with the presence of an ethanol solution and potassium hydroxide to prepare 5-heptadecyl-1,2,4-triazole-3-thione. (El-Sayed R. Substituted thiadiazole, oxadiazole, triazole and triazinone as antimicrobial and surface activity compounds[J]. J. Surfact Deterg, 2013, 16(1): 39-47.) Kumsi et al. enable aryl hydrazide and potassium thiocyanate to be subjected to reaction under acidic conditions to prepare an aroylthiosemicarbazide intermediate, and the intermediate is subjected to reflux cyclization in a sodium hydroxide solution and then acidified to prepare a 5-substituted aryl-1,2,4-triazole-3-thione compound. (Kumsi M., Poojary B, Lobo P. L., et al. Synthesis of some fused triazole derivatives containing 4-isobutylphenylethyl and 4-methylthiophenyl moieties[J]. Zeitschrift fur Naturforschung B, 2010, 65(11): 1353-1358.) Russo et al. prepare an acyl thiosemicarbazide intermediate by hydrazide and ammonium thiocyanate, and then perform heating reflux on the thiosemicarbazide intermediate under alkaline conditions to synthesize 1,2,4-triazole-3-thione. (Russo R, Santagat M., Pappalar G. Benzothiazoles derivatives of 1,2,4-triazole[J]. Annali Di Chimica, 1972, 62(5): 351.)

The 1,2,4,5-tetrazole-3-thione compound is mainly synthesized through a thiourea route or a thiocarbohydrazide route. Gopalakrishnan et al. mix aromatic aldehyde, thiourea and ammonium acetate in a molar ratio of 1:1:2 to obtain 6-substituted phenyl-1,2,4,5-tetrazole-3-thione under $NaHSO_4.SiO_2$ catalysis and microwave radiation. (Gopalakrishnan M., Thanusu J., Kanagarajan V. Easy-to-execute 'one-pot' synthesis of 1, 2, 4, 5-tetrazines catalyzed by activated fly ash[J]. Journal of the Korean Chemical Society, 2007, 51(6): 520-525; Gopalakrishnan M., Sureshkumar P., Kanagaraj an V., Thanusu J. Design, 'one-pot' synthesis, characterization, antibacterial and antifungal activities of novel 6-aryl-1,2,4,5-tetrazinan-3-thiones in dry media[J]. Journal of Sulfur Chemistry, 2007, 18(4): 383-392.) Tashtoush et al. enable thiocarbohydrazide to react with fatty aldehyde or cyclic ketone under acidic conditions to obtain 6-substituted-1,2,4,5-tetrazole-3-thione. (Tashtoush H. I., Abusahyon F., Shkoor M+, et al. Dual behavior of monothiocarbohydrazones in the cyclization with diethyl acetylene dicarboxylate (DEAD): synthesis of substituted 1, 3-thiazolidin-4-ones[J]. Journal of Sulfur Chemistry, 2011, 32(5): 405-412.) Tabassum et al. dissolve acetophenone in an ethanol solution, add thiocarbohydrazide and acetic acid, and perform stirring reaction at room temperature for 2-3 h to prepare 6-aryl-1,2,4,5-tetrazole-3-thione. (Tabassum S., Parveen M., Ali A., et al. Synthesis of aryl-1, 2, 4,5-tetrazinane-3-thiones, in vitro DNA binding studies, nuclease activity and its antimicrobial activity[J]. Journal of Molecular Structure, 2012, 1020: 33-40.)

The chelation of the azolethione compounds with copper, zinc, nickel, gold or silver is also reported in the literatures.

Mashhadizadeha et al. report that the 1,3,4-thiadiazole-2-thione compound can form a chelate with Cu(II). (M. H. Mashhadizadeh, K. Eskandari, A. Foroumadi, A. Shafiee. Copper (II) modified carbon paste electrodes based on self-assembled mercapto compounds-gold-nanoparticle[J]. Talanta, 2008, 76(3): 497-502.) Kannan and John synthesize 5-methyl-1,3,4-thiadiazole-2-thione gold nanoparticles. (P. Kannan and S. A. John. Synthesis of mercaptothiadiazole-functionalized gold nanoparticles and their self-assembly on Au substrates[J]. Nanotechnology 2008, 19(8): 085602.) Matsumoto et al. find that the 5-methyl-1,3,4-thiadiazole-2-thione is self-assembled on gold and copper electrode surfaces by chemical bonds. (F. Matsumoto, M. Ozaki, Y. Inatomi, S. C. Paulson, N. Oyama. Studies on the adsorption behavior of 2,5-dimercapto-1,3,4-thiadiazole and 2-mercapto-5-methyl-1,3,4-thiadiazole at gold and copper electrode surfaces[J]. Langmuir 1999, 15(3): 857-865.) Blajiev et al. report that the 5-methyl-1,3,4-thiadiazole-2-thione can form a chelate with copper so as to achieve a corrosion inhibition effect on the copper surface. (O. L. Blajiev, T. Breugelmans, R. Pintelon, H. Terryn, A. Hubin. Potentiodynamic EIS investigation of the 2-methyl-5-mercapto-1,3,4-thiadiazole adsorption on copper[J]. Electrochimica Acta, 2008, 53(25): 7451-7459.)

Shang et al. prepare a complex of 5-(3-pyridyl)-1,3,4-oxadiazole-2-thione with Cu(I), and find that N on a pyridine ring, N in a 1,3,4-oxadiazole ring and thiocarbonyl S are bonded to Cu atoms. (J. Shang, X. Y. Wu, F. Wang, et al. A new 3D Cu (I) coordination polymer with 4-connected umv topological network[J]. Inorganic Chemistry Communications, 2012, 22: 190-192.) Singh et al. synthesize 5-(4-pyridyl)-1,3,4-oxadiazole-2-thione and a complex of the 5-(4-pyridyl)-1,3,4-oxadiazole-2-thione with Cu(II) and Ni(II). (N. K. Singh, M. K. Bharty, R. Dulare, et al. Synthesis and X-ray crystallographic studies of Ni (II) and Cu (II) complexes of [5-(4-pyridyl)-1,3,4] oxadiazole-2-thione/thiol formed by transformation of N-(pyridine-4-carbonyl)-hydrazine carbodithioate in the presence of ethylenediamine[J]. Polyhedron, 2009, 28(12): 2443-2449.) Al-obaidi et al. synthesize 5-substituted phenyl-1,3,4-oxadiazole-2-thione, and find that the 5-substituted phenyl-1,3,4-oxadiazole-2-thione coordinates with Cu(I) and Cu(II) through N on 1,3,4-oxadiazole and thione S (as shown in formula a). (K. H. Al-Obaidi, B. F. Ali, R. Abu-El-Halawa, et al. Synthesis of 1, 3,4-mercapto-oxadiazole mono- and Binuclear copper (I) and copper (II) complexes and their microbiological activity[J]. Transition metal chemistry, 2004, 29(7): 804-811.)

(Formula a)

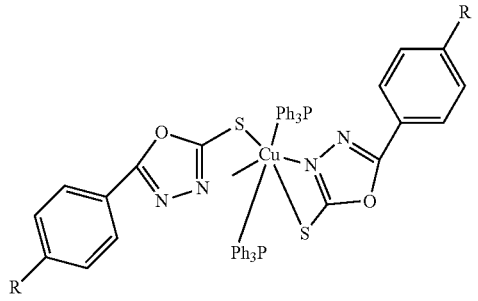

Gudasi et al. synthesize Mn(II), Co(II), Ni(II), Cu(II) and Zn(II) complexes of 1,3,4-oxadiazole-2-thione. (K. Gudasi, M. Patil, R. Vadavi, et al. Transition metal complexes with a new tri dentate ligand, 5-[6-(5-mercapto-1,3,4-oxadiazol-2-yl)pyridin-2-yl]-1,3,4-oxadiazole-2-thiol[J]. J. Serb. Chem. Soc., 2007, 72(4): 357-366.) Xavier and Nallaiyan believe that 5-(2,6-diphenyl-4-hydrazono-pyridine-1-methylene)-1,3,4-oxadiazole-2-thione can delay copper corrosion. (J. R. Xavier, R. Nallaiyan. Corrosion inhibitive properties and electrochemical adsorption behaviour of some piperidine derivatives on brass in natural sea water[J]. Journal of Solid State Electrochemistry, 2012, 16(1): 391-402.)

Singh B. and Singh R. research the coordination modes of transition metal ions such as Co(II), Ni(II) and Cu(II) with 5-(4-pyridine)-1,2,4-triazole-3-thione ligands. (Singh B., Singh R. Transition metal complexes of 3-(4-pyridyl)-triazoline-5-thione[J]. Journal of Inorganic and Nuclear Chemistry, 1972, 34(11): 3449-3454.) Scozzafava et al. research the structure of the chelate of 4,5-disubstituted-1,2,4-triazole-3-thione with Zn(II), Hg(II) and Cu(I). (Scozzafava A., Cavazza C., Supuran C. T., et al. Complexes with biologically active ligands. Part 11. Synthesis and carbonic anhydrase inhibitory activity of metal complexes of 4,5-disubstituted-3-mercapto-1,2,4-triazole derivatives[J]. Metal-based drugs, 1998, 5(1): 11-18.) Pergolese and Bigotto believe that the 1,2,4-triazole-3-thione is bonded with silver in an ionized thiol form through lone pair electrons of sulfur and nitrogen so as to be adsorbed on the silver surface.

(Pergolese B., Bigotto A. Study by SERS spectroscopy of the adsorption of 1H-1,2,4-triazole-3-thione on silver sols [J]. Journal of Molecular Structure, 2003, 651-653: 349-352.) O'Neil and Phillips find that the 1,2,4-triazole-3-thione compound has a good inhibitory effect on copper corrosion. (O'Neil R. M., Phillips E. Corrosion inhibition [P], GB2182030A, 1987.5.7.)

Nöth et al. find that in transition metal Cu(I), Ag(I), Au(I), Au(II) and Pd(II) complexes of the 1,2,4,5-tetrazole-3-thione, the metal preferentially coordinates with the sulfur atom in the ligand. (Nöth H., Beck W., Burger K. The molecular structure of some transition-metal complexes with 1, 2, 3, 4-Tetrazole-5-thiolate Anions[J]. European Journal of Inorganic Chemistry, 1998, 1998(1): 93-99.) Khan et al. investigate the corrosion resistance of 6,6-cyclopentyl-1,2,4,5-tetrazole-3-thione, 6,6-cyclohexyl-1,2,4,5-tetrazole-3-thione and 6,6-isobutylmethyl-1,2,4,5-tetrazole-3-thione to carbon steel in formic acid and acetic acid solutions. (S. Khan, M. Z. A. Rafiquee, N. Saxena, M. A. Quraishi. Inhibition of carbon steel corrosion by azathione derivatives in organic acid solutions[J], Anti-Corrosion Methods and Materials, 2009, 56 (3): 145-153.)

At present, the existing technologies have no report on the use of azolethione compounds as flotation collectors.

SUMMARY

The present invention is directed to application of a flotation collector containing an azolethione structure in metal mineral flotation, and aims to increase the enrichment and recovery efficiency of valuable metal minerals in ores containing copper, zinc, lead, nickel, cobalt, platinum, palladium, silver and gold minerals.

According to the application of the flotation collector containing the azolethione structure, a flotation collector containing an azolethione compound having the structure as shown in formula 1 is applied to ores containing at least one of copper minerals, zinc minerals, lead minerals, nickel minerals, cobalt minerals, platinum minerals, palladium minerals, silver minerals and gold minerals to realize flotation recovery of these valuable minerals, Formula 1

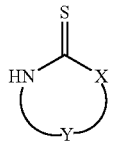

wherein X is NH, O or S, and Y is

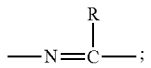

or,

X is NH, and Y is

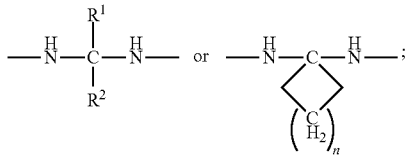

R is a $C_1$-$C_{17}$ hydrocarbyl group or an alkoxy ether group having the structure as shown in formula 2;

Formula 2

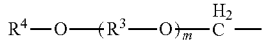

$R^1$ is a $C_1$-$C_{17}$ hydrocarbyl group; $R^2$ is H or a $C_1$-$C_3$ alkane group;

and n is an integer from 2 to 5.

In the formula 2, $R^4$ is a $C_1$-$C_{17}$ hydrocarbyl group, $R^3$ is an ethylidene group or a propylidene group, and m is 1-3.

The inventors have found that a compound having a main core structure as shown in formula 1, serving as a flotation collector, is favorable for enrichment and recovery of valuable metals in ores containing copper minerals, zinc minerals, lead minerals, nickel minerals, cobalt minerals, platinum minerals, palladium minerals, silver minerals and gold minerals.

The compound having the structure as shown in formula 1 can be classified into a five-membered-ring azolethione collector or a six-membered-ring tetrazolethione collector according to different Y groups.

The present invention provides a preferred embodiment (embodiment a): Y is

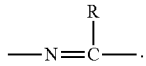

When Y is a group of

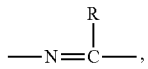

and X is NH, O or S, the compound having the structure as shown in formula 1 is the five-membered-ring azolethione collector. Preferably, the atom C in Y is connected with X. Under the preferred condition, the flotation collector containing the compound having the structure as shown in formula 1 has the structure as shown in formula 3:

Formula 3

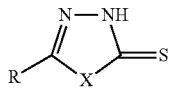

The compound having the structure as shown in formula 3 is specifically one of the compounds having the structures as shown in formula 4, formula 5 and formula 6. Azolethione flotation collectors having the structures as shown in formula 4, formula 5 and formula 6 are applied to ores containing at least one of copper minerals, zinc minerals, lead minerals, nickel minerals, cobalt minerals, platinum minerals, palladium minerals, silver minerals and gold minerals to realize flotation recovery of valuable metal minerals.

Formula 4

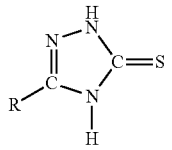

The structural formula 4 shows a flotation collector having a 1,2,4-triazole-3-thione structure.

Formula 5

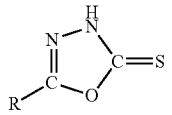

The structural formula 5 shows a flotation collector having a 1,3,4-oxadiazole-2-thione structure.

Formula 6

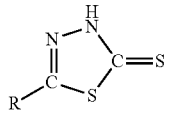

The structural formula 6 shows a flotation collector having a 1,3,4-thiadiazole-2-thione structure.

In the compound having the structure as shown in formula 3, the R group provides good hydrophobicity for the flotation collector.

R is a $C_1$-$C_{17}$ hydrocarbyl group, that is, R is a hydrocarbon group containing 1-17 carbon atoms. For example, R can be (1) a saturated alkane, such as a linear alkane or a branched alkane; (2) an olefinic group or an olefinic alkyl group containing single or multiple double bonds; (3) a saturated or unsaturated cycloalkane, and the cycloalkane group is preferably a five-membered ring or a six-membered ring; (4) an alkylaryl group or an arylalkyl group having an aromatic structure, such as an alkyl-substituted phenyl group, an alkyl-substituted fused ring aryl group, a phenyl group or a fused ring arylalkyl group.

Preferably, R is a $C_1$-$C_{17}$ alkane group, or a $C_2$-$C_{17}$ olefinic group, or a $C_6$-$C_{12}$ aryl group.

Preferably, R is a $C_1$-$C_{17}$ alkane group, such as a linear $C_1$-$C_{17}$ alkyl group or a branched $C_1$-$C_{17}$ alkyl group.

Further preferably, R is a linear $C_1$-$C_{17}$ alkane group.

For example, R is methyl, ethyl, n-propyl, n-butyl, n-pentyl, n-hexyl, n-heptyl, n-octyl, n-nonyl, n-decyl, n-hendecyl, n-dodecyl, n-tridecyl, n-tetradecyl, n-pentadecyl, n-hexadecyl or n-heptadecyl.

Preferably, R is a $C_{10}$-$C_{17}$ monoolefine group.

The $C_{10}$-$C_{17}$ monoolefine group can be an alkyl olefinic group (for example, unsaturated double-bond carbon is directly bonded to carbon on a 1,2,4-triazole ring), or an olefinic alkyl group (for example, unsaturated double-bond carbon is bonded to a 1,2,4-triazole ring through saturated carbon). For example, R is 1-nonenyl or 3-olefinyl.

Preferably, R is propyl, pentyl, hexyl, heptyl, nonyl, n-hendecyl, n-tridecyl, n-pentadecyl, n-heptadecyl or 8-heptadecenyl.

R can also be selected from the group having the structure as shown in formula 2. The selection range of the $R^4$ group is the same as the selection range of R.

Preferably, in formula 2, $R^4$ is a $C_1$-$C_{17}$ alkane group, or a $C_2$-$C_{17}$ olefinic group, or a $C_6$-$C_{12}$ aryl group.

Further preferably, $R^4$ is a linear $C_1$-$C_{17}$ alkane group or a $C_{10}$-$C_{17}$ monoolefine group.

Preferably, in formula 2, $R^3$ is an ethylidene group.

Further preferably, in formula 2, $R^3$ is an ethylidene group, and $R^4$ is a linear $C_1$-$C_{17}$ alkane group or a $C_{10}$-$C_{17}$ monoolefine group.

Preferably, in formula 2, $R^4$ is propyl, pentyl, hexyl, heptyl, nonyl, n-hendecyl, n-tridecyl, n-pentadecyl, n-heptadecyl or 8-heptadecenyl.

The present invention provides another preferred embodiment (embodiment b): X is NH, and Y is

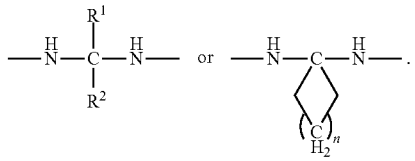

When X is NH, and Y is

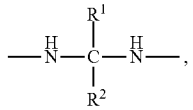

the flotation collector is a 1,2,4,5-tetrazole-3-thione compound having the structure as shown in formula 7.

Formula 7

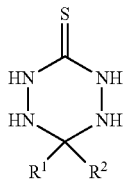

$R^2$ and $R^1$ groups in the compound having the structure as shown in formula 7 are used for providing good hydrophobicity for the collector.

$R^1$ is a $C_1$-$C_{17}$ hydrocarbyl group, that is, $R^1$ is a hydrocarbon group containing 1-17 carbon atoms. For example, $R^1$ can be (1) a saturated alkane, such as a linear alkane or a branched alkane; (2) an olefinic group or an olefinic alkyl group containing single or multiple double bonds; (3) a saturated or unsaturated cycloalkane, and the cycloalkane group is preferably a five-membered ring or a six-membered ring; (4) an alkylaryl group or an arylalkyl group having an aromatic structure, such as an alkyl-substituted phenyl group, an alkyl-substituted fused ring aryl group, a phenylalkyl group or a fused ring arylalkyl group.

Preferably, $R^1$ is a $C_1$-$C_{17}$ alkane group, or a $C_2$-$C_{17}$ olefinic group, or a $C_6$-$C_{12}$ aryl group.

Preferably, $R^1$ is a $C_1$-$C_{17}$ alkane group, such as a linear alkyl group or a branched alkyl group.

Further preferably, in formula 7, $R^1$ is a linear $C_1$-$C_{17}$ alkane group.

For example, $R^1$ is methyl, ethyl, n-propyl, n-butyl, n-pentyl, n-hexyl, n-heptyl, n-octyl, n-nonyl, n-decyl, n-hendecyl, n-dodecyl, n-tridecyl, n-tetradecyl, n-pentadecyl, n-hexadecyl or n-heptadecyl.

Preferably, in formula 7, $R^1$ is a $C_{10}$-$C_{17}$ monoolefine group.

The $C_{10}$-$C_{17}$ monoolefine group can be an alkyl olefinic group (unsaturated double-bond carbon is directly bonded to carbon on a 1,2,4,5-tetrazole-3-thione parent core), or an olefinic alkyl group (unsaturated double-bond carbon is bonded to a 1,2,4,5-tetrazole-3-thione parent core through saturated carbon). For example, $R^1$ is 1-nonenyl or 3-olefinyl.

Further preferably, in formula 7, $R^1$ is propyl, pentyl, hexyl, heptyl or nonyl. The preferred groups are all linear groups.

In formula 7, $R^2$ is H, methyl, ethyl, propyl or isopropyl.

Preferably, in formula 7, $R^2$ is H or methyl.

When X is NH, and Y is

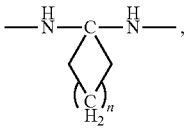

the flotation collector containing the compound having the structure as shown in formula 1 is a 1,2,4,5-tetrazole-3-thione compound having the structure as shown in formula 8.

Formula 8

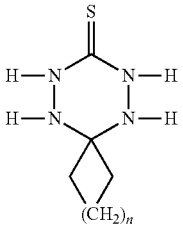

In the compound having the structure as shown in formula 8, a saturated cycloalkane and six positions of the 1,2,4,5-tetrazole-3-thione parent core share carbon atoms to form a spiral structure. The spiral structure is used for providing good hydrophobicity for the collector. The saturated cycloalkane is preferably a five-membered, six-membered, seven-membered or eight-membered saturated cycloalkane, that is, n is selected from any integer from 2 to 5.

Preferably, in formula 8, n is 3.

According to a preferred application method in the present invention, the flotation collector having the structure as shown in formula 1 (or at least one of the preferred compounds having the structures as shown in formula 4, formula 5, formula 6, formula 7 and formula 8) is used as a flotation collector to be in contact with the ore pulp containing copper minerals, zinc minerals, lead minerals, nickel minerals, cobalt minerals, platinum minerals, palladium minerals, silver minerals and gold minerals to achieve the purpose of efficiently recovering valuable metals such as copper, silver and gold. The preferred embodiment of the present invention includes the following steps:

step (1): crushing, grinding and pulping the ore containing at least one of copper minerals, zinc minerals, lead minerals, nickel minerals, cobalt minerals, platinum minerals, palladium minerals, silver minerals and gold minerals to obtain ore pulp;

step (2): adding a flotation agent to the ore pulp obtained in step (1) for flotation, and collecting a flotation concentrate, wherein the flotation agent includes the flotation collector.

In step (1), the existing technologies are adopted for pulverization of the ore. For example, in step (1), the ore is first crushed by a jaw crusher and a fine crusher and then ground by a ball mill.

Preferably, in step (2), the flotation reagents can also include flotation materials such as foaming agents and/or modifying agents.

In the present invention, preferably, the pH value of the ore pulp is controlled to be neutral or alkaline; preferably, the pH value is 7-13; further preferably, the pH value is 8-10; and more preferably, the pH value is 8.5-9.

Preferably, in step (1), the addition amount of the flotation collector is 10-500 g/t based on the weight of the ore, and further preferably, the addition amount of the flotation collector is 40-100 g/t.

The 1,3,4-thiadiazole-2-thione compound (compound having the structure as shown in formula 6) of the present invention can be prepared by low-temperature (less than 5° C.) cyclization reaction of the corresponding organic amidodithiocarbamate with the presence of concentrated sulfuric acid.

The 1,3,4-oxadiazole-2-thione compound (compound having the structure as shown in formula 5) can be prepared by performing heating reflux on the corresponding N—(N'-alkylamide) dithiocarbamate in a solvent medium and then performing acidification or can be prepared by directly performing reflux reaction on hydrazide with KOH and $CS_2$ in an organic solvent and then performing acidification.

The 1,2,4-triazole-3-thione compound (compound having the structure as shown in formula 4) can be prepared by performing heating reflux and cyclization on acylthiosemicarbazide in an alkaline medium and then performing acidification.

The 1,2,4,5-tetrazole-3-thione compound (compound having the structures as shown in formula 7 and formula 8) can be prepared by performing heating cyclization reaction on the corresponding organic aldehyde or ketone with dithiosemicarbazide in an organic medium with the presence of acetic acid.

The collector of the present invention can increase the flotation grade and recovery, and improve the flotation recovery of metal minerals. For a mineral processing subject with a development history of more than 100 years, each percentage increase in flotation recovery ratio is a huge improvement and can generate tens of billions of economic value for the global mining industry.

The present invention has the beneficial effects that the present invention applies the azolethione compound to froth flotation and beneficiation of valuable metal minerals for the first time, and is especially suitable for enrichment and recovery of valuable metals in ores containing copper, zinc, lead, nickel, cobalt, platinum, palladium, silver or gold minerals. Compared with an existing common collector, the collector of the present invention can increase the recovery ratio of valuable metal minerals.

DESCRIPTION OF THE EMBODIMENTS

Figure 1:
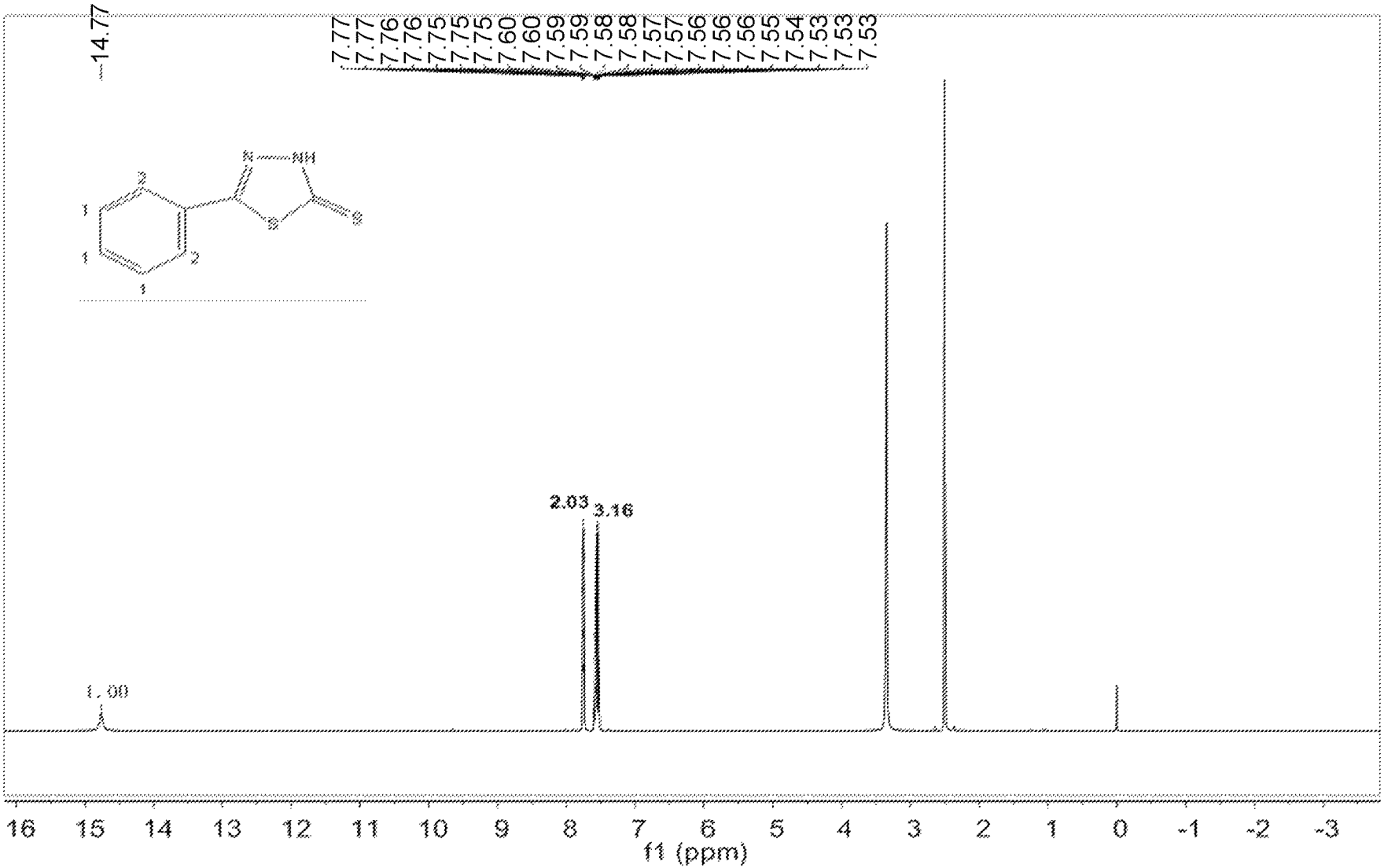
FIG. 1 shows 5-phenyl-1,3,4-thiadiazole-2-thione $^1$HNMR.
Figure 2:
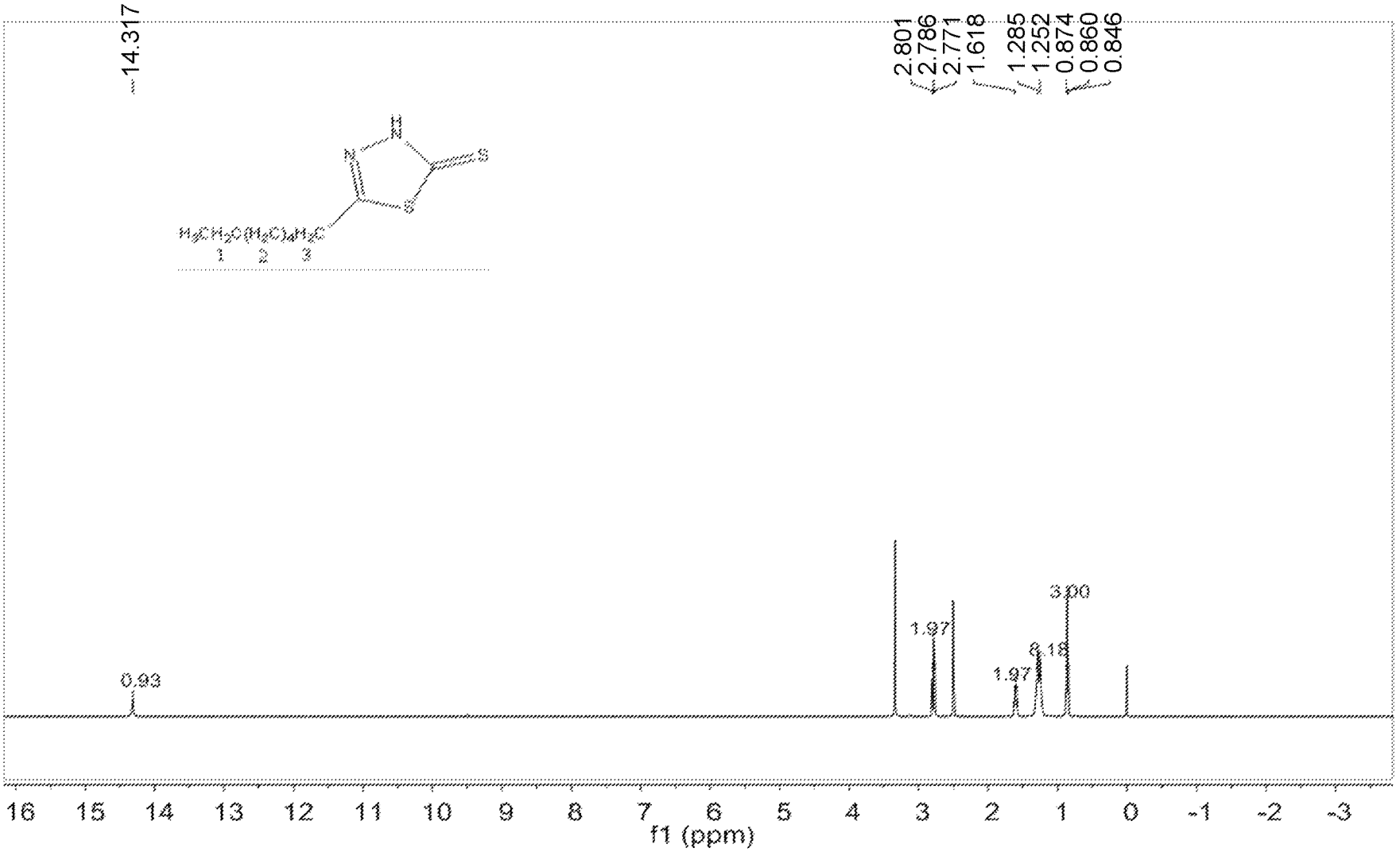
FIG. 2 shows 5-heptyl-1,3,4-thiadiazole-2-thione $^1$HNMR.
Figure 3:
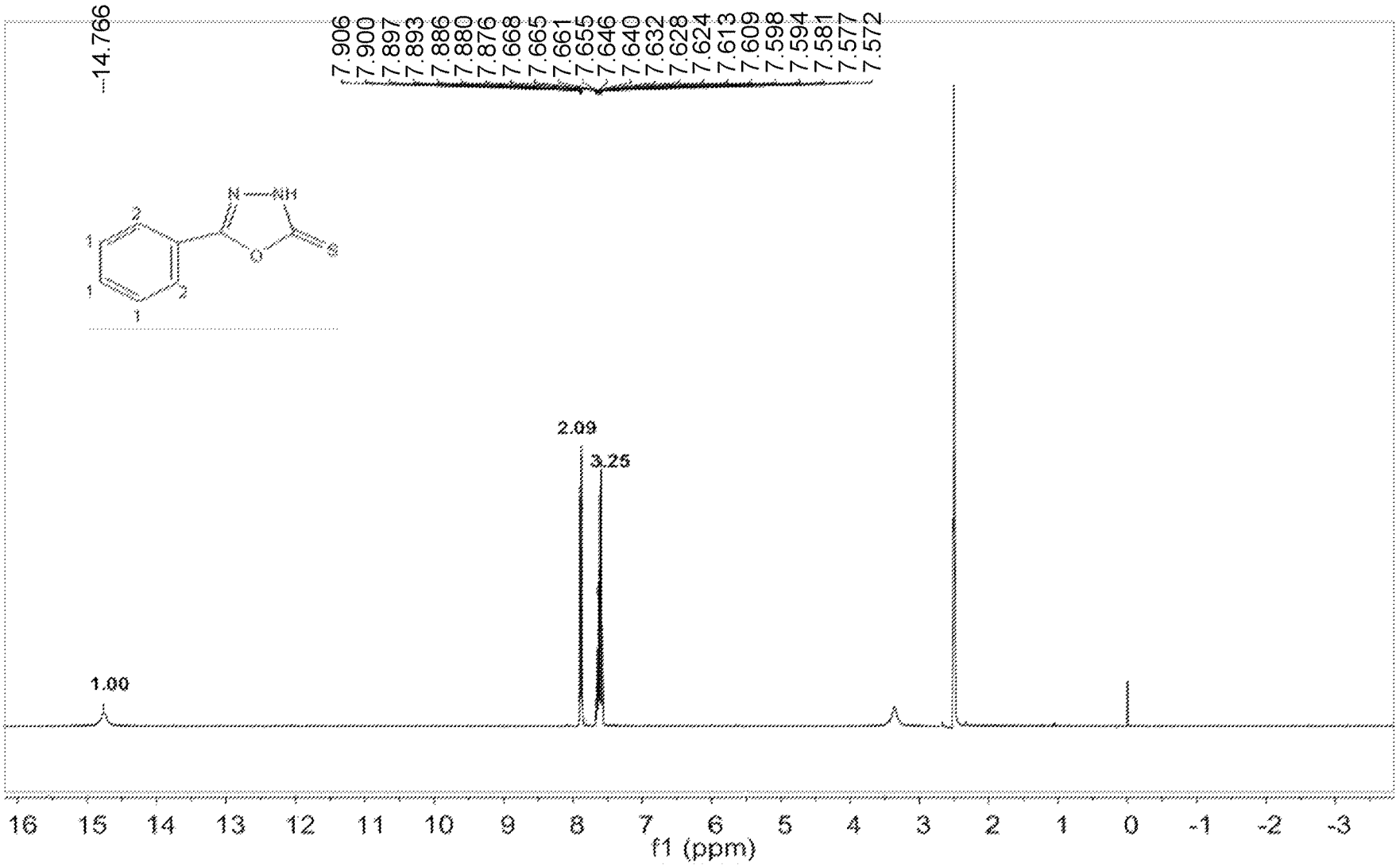
FIG. 3 shows 5-phenyl-1,3,4-oxadiazole-2-thione $^1$HNMR.
Figure 4:
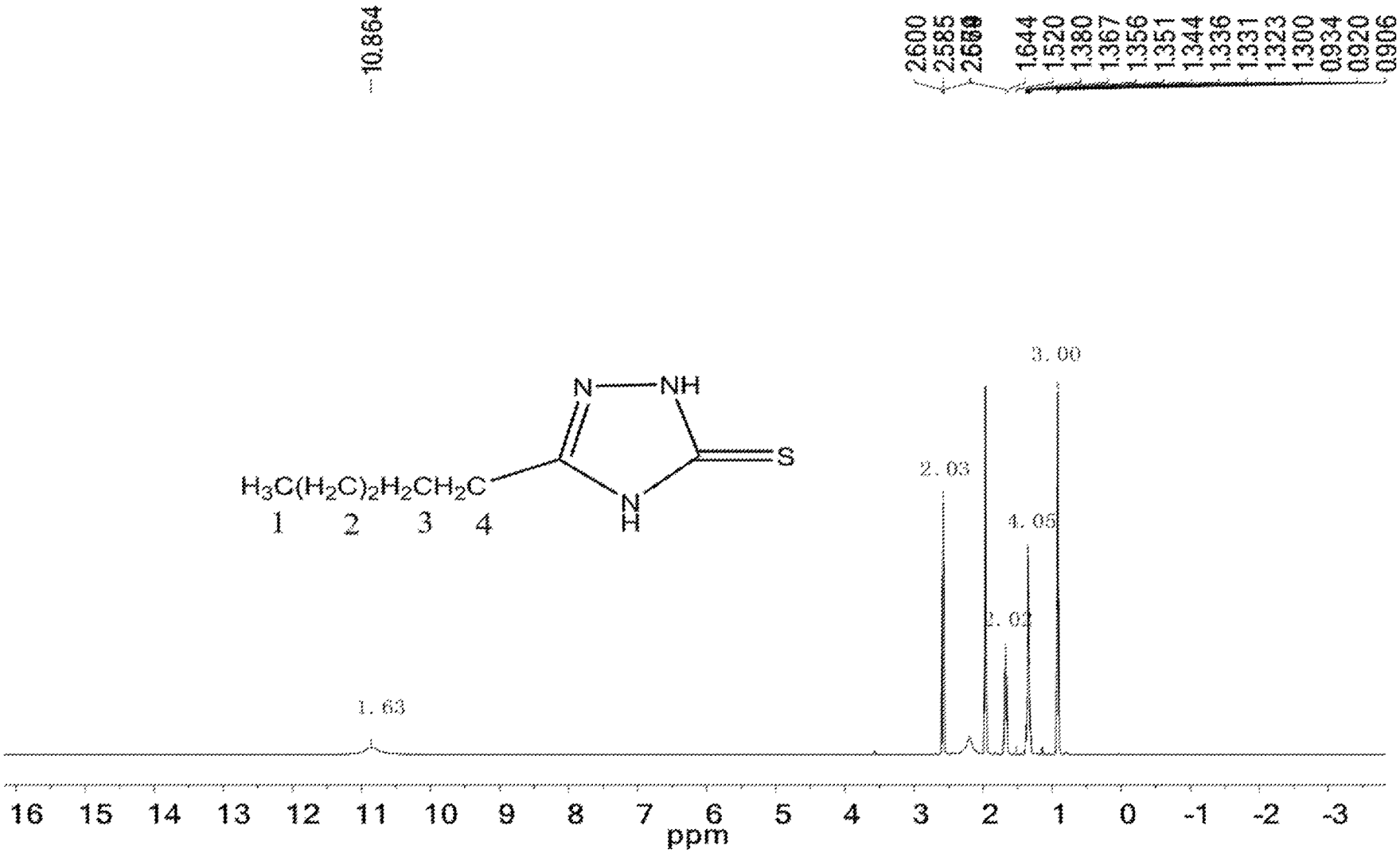
FIG. 4 shows 5-pentyl-1,2,4-triazole-3-thione $^1$HNMR.
Figure 5:
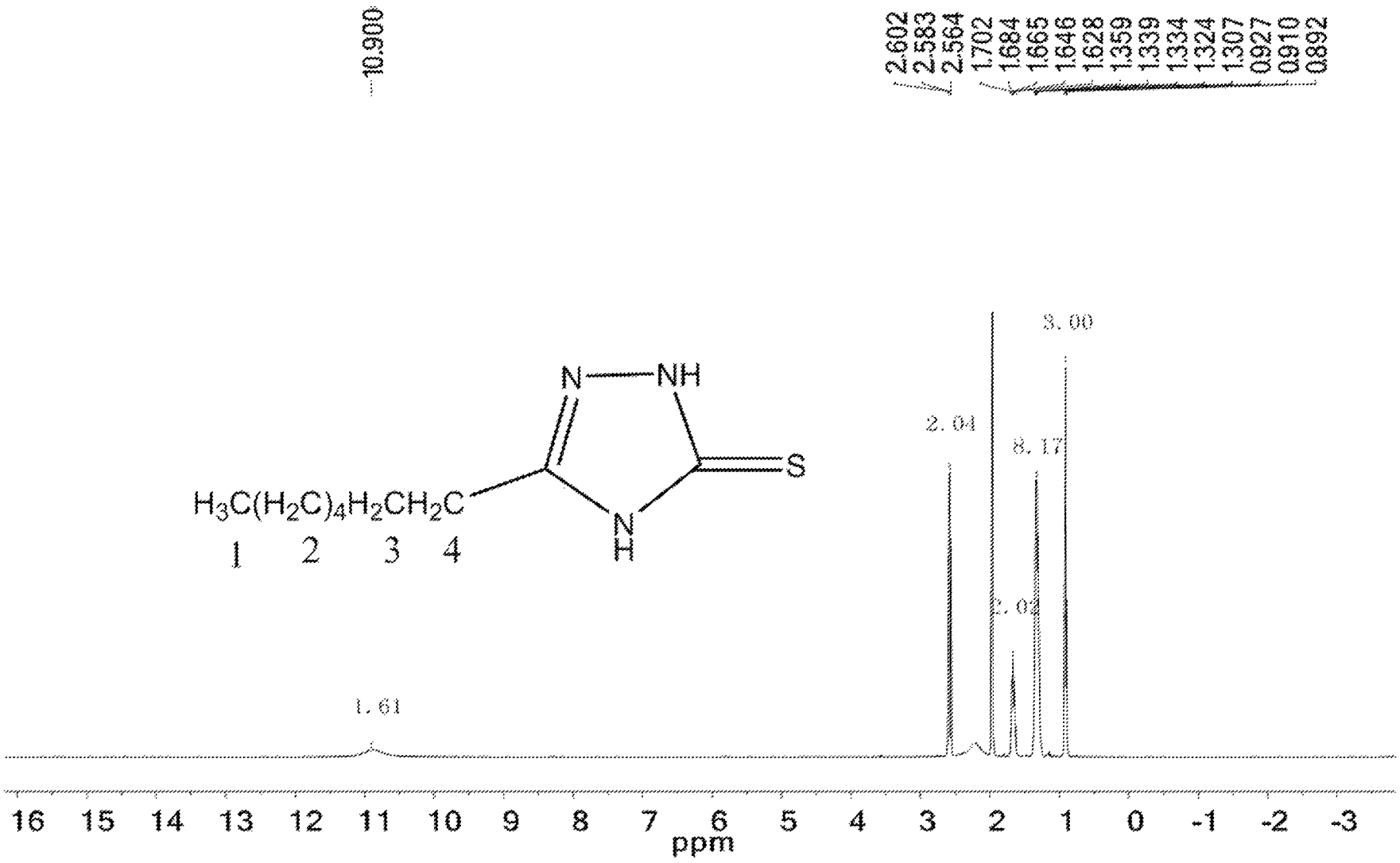
FIG. 5 shows 5-heptyl-1,2,4-triazole-3-thione $^1$HNMR.
Figure 6:
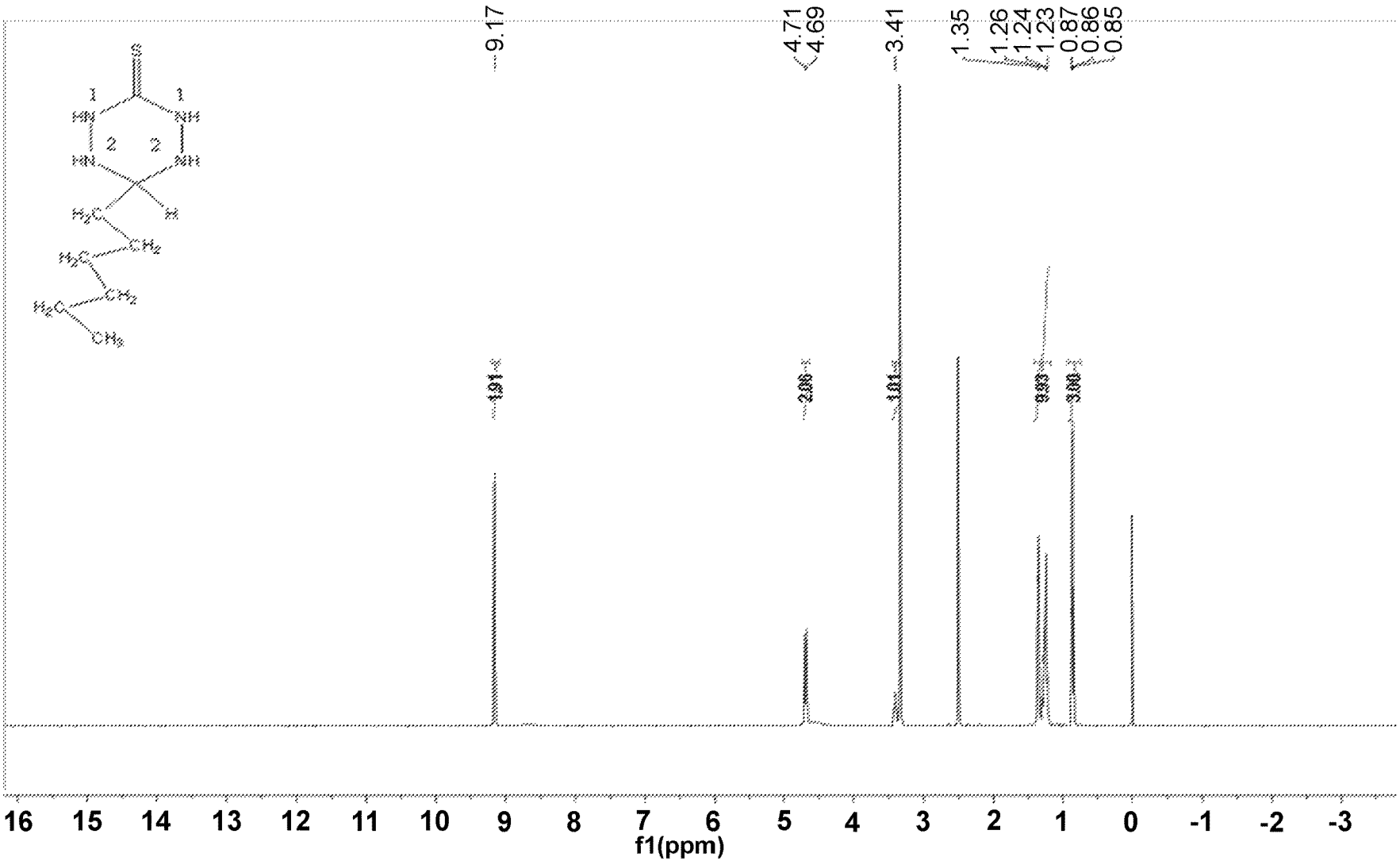
FIG. 6 shows 6-hexyl-1,2,4,5-tetrazole-3-thione $^1$HNMR.

The following embodiments are intended to further illustrate the content of the present invention and are not intended to limit the protection scope of the present invention.

All parts and percentages in the embodiments refer to mass unless additionally specified. The froth flotation processes for minerals or ores in the embodiments are conventional processes except that a conventional collector is replaced with the azolethione compound of the present invention.

The adding weight unit of each flotation agent in the following embodiments is g/t, and is based on the ore weight (t) unless particularly specified.

Embodiment 1 Hallimond Tube Flotation Test of Pure Chalcopyrite

Under the conditions of a certain concentration of the collector and a certain pH value of the ore pulp, the concentration of methyl isobutyl carbinol (MIBC) frother is fixed on 15 mg/L, the flow rate of $N_2$ gas is 200 mL/min, the chalcopyrite of which the particle size is from −0.076 mm to +0.038 mm is subjected to flotation for 3 min in a Hallimond tube, and the flotation recovery of the chalcopyrite is shown in table 1. The test results in table 1 show that the azolethione collector obtains a higher chalcopyrite recovery than isoamyl xanthate.

TABLE 1

Hallimond tube flotation test conditions and results of pure chalcopyrite

| Collector type | Concentration (mol/L) | pH value of ore pulp | Chalcopyrite recovery/% |
|---|---|---|---|
| Isoamyl xanthate | $2 \times 10^{-5}$ | 9.0 | 87.6 |
| 5-hexyl-1,3,4-thiadiazole-2-thione | $1 \times 10^{-5}$ | 9.0 | 96.7 |
| 5-heptyl-1,3,4-oxadiazole-2-thione | $2 \times 10^{-5}$ | 9.0 | 97.2 |
| 5-pentyl-1,2,4-triazole-3-thione | $2 \times 10^{-5}$ | 8.5 | 93.5 |
| 6-hexyl-1,2,4,5-tetrazole-3-thione | $1 \times 10^{-5}$ | 8.5 | 93.2 |

Embodiment 2 Hallimond Tube Flotation Test of Pure Malachite

Under the conditions of a certain concentration of the collector and a certain pH value of the ore pulp, the MIBC frother is fixed on 15 mg/L, the flow rate of $N_2$ gas is 200 mL/min, the malachite of which the particle size is from −0.076 mm to +0.038 mm is subjected to flotation for 3 min in a Hallimond tube, and the flotation recovery ratio of the malachite is shown in table 2. The test results in table 2 show that the azolethione collector returns a higher malachite flotation recovery than isoamyl xanthate and octyl hydroxamic acid.

TABLE 2

Hallimond tube flotation test conditions and results of pure malachite

| Collector type | Concentration (mol/L) | pH value of ore pulp | Malachite recovery/% |
|---|---|---|---|
| Isoamyl xanthate | $2 \times 10^{-4}$ | 8.0 | 75.2 |
| Octyl hydroxamic acid | $2 \times 10^{-4}$ | 8.5 | 88.5 |
| 5-hexanol polyethylene (2) ether methyl-1,3,4-thiadiazole-2-thione | $1 \times 10^{-4}$ | 9.0 | 96.4 |
| 5-octanol polyethylene (2) ether methyl-1,3,4-oxadiazole-2-thione | $1 \times 10^{-4}$ | 8.5 | 94.8 |
| 5-hexanol polyethylene (2) ether methyl-1,2,4-triazole-3-thione | $2 \times 10^{-4}$ | 8.0 | 98.7 |
| 6,6-methylhexyl-1,2,4,5-tetrazole-3-thione | $2 \times 10^{-4}$ | 8.5 | 97.6 |

Embodiment 3

In a sulfide-oxide copper ore sample in Dongchuan, Yunnan, China, a raw ore contains 0.63% of Cu, and the oxidation ratio is 26.5%. Test processes include one rougher process and one scavenger process. The ore is ground to 90% passing −0.074 mm. Flotation reagent conditions include 300 g/ton sodium sulfide (pH value of ore pulp is 7.5) in rougher operation, and 800 g/ton sodium sulfide (pH value of ore pulp is 8.0) in scavenger process. Other reagent conditions and results thereof are as shown in table 3. The test results in table 3 show that the azolethione collector of the present invention achieve a higher copper recovery (scavenger concentrate) than butyl xanthate.

TABLE 3

Conditions and results of flotation of sulfide-oxide copper ore in Dongchuan by azolethione collector

| Flotation reagent type and dosage (g/t) | Product name | Yield/% | Copper grade/% | Copper recovery/% |
|---|---|---|---|---|
| Rougher: butyl xanthate 100, MIBC 30 | Rougher concentrates | 2.23 | 20.38 | 72.52 |
| Scavenger: butyl xanthate 100 | Scavenger concentrates | 0.70 | 2.87 | 3.18 |
| | Tailings | 97.07 | 0.157 | 24.30 |
| | Raw ores | 100.00 | 0.627 | 100.00 |
| Rougher: butyl xanthate 100, MIBC 30 | Rougher concentrates | 2.20 | 20.43 | 72.32 |
| Scavenger: 5-phenyl-1,3,4-thiadiazole-2-thione 60 | Scavenger concentrates | 0.66 | 5.78 | 6.13 |
| | Tailings | 97.14 | 0.138 | 21.55 |
| | Raw ores | 100.00 | 0.622 | 100.00 |

TABLE 3-continued

Conditions and results of flotation of sulfide-oxide copper ore in Dongchuan by azolethione collector

| Flotation reagent type and dosage (g/t) | Product name | Yield/% | Copper grade/% | Copper recovery/% |
|---|---|---|---|---|
| Rougher: butyl xanthate 100, MIBC 30 | Rougher concentrates | 2.19 | 20.86 | 72.31 |
| Scavenger: 5-hexyl-1,3,4-thiadiazole-2- | Scavenger concentrates | 3.62 | 2.18 | 12.49 |
| thione 60 | Tailings | 94.19 | 0.102 | 15.20 |
| | Raw ores | 100.00 | 0.632 | 100.00 |
| Rougher: butyl xanthate 100, MIBC 30 | Rougher concentrates | 2.19 | 21.04 | 72.80 |
| Scavenger: 5-phenyl-1,3,4-oxadiazole-2- | Scavenger concentrates | 0.79 | 5.39 | 6.76 |
| thione 60 | Tailings | 97.02 | 0.133 | 20.43 |
| | Raw ores | 100.00 | 0.632 | 100.00 |
| Rougher: butyl xanthate 100, MIBC 30 | Rougher concentrates | 2.23 | 20.42 | 72.86 |
| Scavenger: 5-hexyl-1,3,4-oxadiazole-2- | Scavenger concentrates | 2.19 | 2.45 | 8.61 |
| thione 60 | Tailings | 95.58 | 0.121 | 18.53 |
| | Raw ores | 100.00 | 0.624 | 100.00 |
| Rougher: butyl xanthate 100, MIBC 30 | Rougher concentrates | 2.13 | 21.29 | 72.20 |
| Scavenger: 5-phenyl-1,2,4-triazole-3- | Scavenger concentrates | 0.65 | 6.91 | 7.09 |
| thione 60 | Tailings | 97.22 | 0.134 | 20.71 |
| | Raw ores | 100.00 | 0.629 | 100.00 |
| Rougher: butyl xanthate 100, MIBC 30 | Rougher concentrates | 2.36 | 19.42 | 72.55 |
| Scavenger: 5-pentyl-1,2,4-triazole-3- | Scavenger concentrates | 1.19 | 5.32 | 10.03 |
| thione 60 | Tailings | 96.45 | 0.114 | 17.42 |
| | Raw ores | 100.00 | 0.631 | 100.00 |
| Rougher: butyl xanthate 100, MIBC 30 | Rougher concentrates | 2.08 | 21.93 | 72.92 |
| Scavenger: 5-hendecyl-1,2,4-triazole-3- | Scavenger concentrates | 2.97 | 2.32 | 11.00 |
| thione 60 | Tailings | 94.95 | 0.106 | 16.08 |
| | Raw ores | 100.00 | 0.626 | 100.00 |
| Rougher: butyl xanthate 100, MIBC 30 | Rougher concentrates | 2.11 | 21.94 | 73.14 |
| Scavenger: 6-phenyl-1,2,4,5-tetrazole-3- | Scavenger concentrates | 0.62 | 7.25 | 7.09 |
| thione 60 | Tailings | 97.27 | 0.129 | 19.78 |
| | Raw ores | 100.00 | 0.634 | 100.00 |
| Rougher: butyl xanthate 100, MIBC 30 | Rougher concentrates | 2.08 | 21.83 | 72.23 |
| Scavenger: 6-hexyl-1,2,4,5-tetrazole-3- | Scavenger concentrates | 0.66 | 8.61 | 9.08 |
| thione 60 | Tailings | 97.25 | 0.121 | 18.69 |
| | Raw ores | 100.00 | 0.630 | 100.00 |

Embodiment 4

In an oxide-sulfide copper ore sample in Changdu, Tibet, a raw ore contains 3.9% of Cu, the oxidation ratio is 69.4%, and main copper oxide minerals include malachite and azurite. Test processes include one rougher process and one scavenger process. The ore is ground to 80% passing −0.074 mm. Flotation reagent conditions include 3,000 g/ton sodium sulfide (pH value of ore pulp is 8.5) in rougher process, and 1,000 g/ton sodium sulfide (pH value of ore pulp is 9.0) scavenger process. Other reagent conditions and results thereof are as shown in table 4. The test results in table 4 show that the azolethione collector obtains a higher copper recovery (scavenger concentrates) than isoamyl xanthate as well as isoamyl xanthate+octyl hydroxamic acid.

TABLE 4

Conditions and results of flotation of oxide-sulfide copper ore in Changdu, Tibet

| Reagent type and dosage (g/t) | Product name | Yield/% | Copper grade/% | Copper recovery/% |
|---|---|---|---|---|
| Rougher: isoamyl xanthate 300, MIBC | Rougher concentrates | 9.54 | 19.51 | 47.70 |
| 24 | Scavenger concentrates | 6.10 | 13.82 | 21.61 |
| Scavenger: butyl xanthate 100, MIBC 12 | Tailings | 84.35 | 1.42 | 30.69 |
| | Raw ores | 100.00 | 3.903 | 100.00 |
| Rougher: isoamyl xanthate 300, MIBC | Rougher concentrates | 9.68 | 19.31 | 47.74 |
| 24 | Scavenger concentrates | 6.29 | 15.02 | 24.14 |
| Scavenger: isoamyl xanthate 100, octyl | Tailings | 84.03 | 1.31 | 28.12 |
| hydroximic acid 50 | Raw ores | 100.00 | 3.914 | 100.00 |
| Rougher: isoamyl xanthate 300, MIBC | Rougher concentrates | 9.40 | 19.64 | 47.51 |
| 24 | Scavenger concentrates | 6.43 | 17.85 | 29.54 |
| Scavenger: 5-pentyl-1,3,4-thiadiazole-2- | Tailings | 84.16 | 1.06 | 22.95 |
| thione 60 | Raw ores | 100.00 | 3.887 | 100.00 |
| Rougher: isoamyl xanthate 300, MIBC | Rougher concentrates | 9.67 | 19.18 | 47.14 |
| 24 | Scavenger concentrates | 7.76 | 16.37 | 32.28 |
| Scavenger: 5-heptyl-1,3,4-thiadiazole-2- | Tailings | 82.58 | 0.98 | 20.58 |
| thione 50 | Raw ores | 100.00 | 3.933 | 100.00 |
| Rougher: isoamyl xanthate 300, MIBC | Rougher concentrates | 9.79 | 19.24 | 47.95 |
| 24 | Scavenger concentrates | 6.87 | 16.52 | 28.92 |

TABLE 4-continued

Conditions and results of flotation of oxide-sulfide copper ore in Changdu, Tibet

| Reagent type and dosage (g/t) | Product name | Yield/% | Copper grade/% | Copper recovery/% |
|---|---|---|---|---|
| Scavenger: 5-heptyl-1,3,4-oxadiazole-2-thione 60 | Tailings | 83.34 | 1.09 | 23.13 |
| | Raw ores | 100.00 | 3.927 | 100.00 |
| Rougher: isoamyl xanthate 300, MIBC 24 | Rougher concentrates | 9.96 | 18.68 | 47.75 |
| | Scavenger concentrates | 8.34 | 14.32 | 30.66 |
| Scavenger: 5-hendecyl-1,3,4-oxadiazole-2-thione 50 | Tailings | 81.69 | 1.03 | 21.59 |
| | Raw ores | 100.00 | 3.897 | 100.00 |
| Rougher: isoamyl xanthate 300, MIBC 24 | Rougher concentrates | 9.67 | 19.34 | 47.55 |
| | Scavenger concentrates | 6.73 | 17.11 | 29.27 |
| Scavenger: 5-pentyl-1,2,4-triazole-3-thione 60 | Tailings | 83.61 | 1.09 | 23.18 |
| | Raw ores | 100.00 | 3.932 | 100.00 |
| Rougher: isoamyl xanthate 300, MIBC 24 | Rougher concentrates | 9.71 | 19.27 | 47.57 |
| | Scavenger concentrates | 7.79 | 16.29 | 32.28 |
| Scavenger: 5-(2,2,4-trimethyl)-pentyl-1,2,4-triazole-3-thione 50 | Tailings | 82.50 | 0.96 | 20.15 |
| | Raw ores | 100.00 | 3.932 | 100.00 |
| Rougher: isoamyl xanthate 300, MIBC 24 | Rougher concentrates | 9.27 | 20.14 | 47.50 |
| | Scavenger concentrates | 6.77 | 16.72 | 28.79 |
| Scavenger: 6-(1,5-pentylidene)-1,2,4,5-tetrazole-3-thione 60 | Tailings | 83.96 | 1.11 | 23.71 |
| | Raw ores | 100.00 | 3.931 | 100.00 |
| Rougher: isoamyl xanthate 300, MIBC 24 | Rougher concentrates | 9.36 | 19.88 | 47.36 |
| | Scavenger concentrates | 8.31 | 15.47 | 32.73 |
| Scavenger: 5-heptyl-1,2,4,5-tetrazole-3-thione 50 | Tailings | 82.32 | 0.95 | 19.90 |
| | Raw ores | 100.00 | 3.929 | 100.00 |

Embodiment 5

In a porphyry copper ore sample in Shangrao, Jiangxi, a raw ore contains 0.39% of copper and 1.85% of sulfur, the content of gold is 0.21 g/t, and the content of silver is 1.18 g/t. A test process includes one rougher process. The ore is ground to 68% passing −0.074 mm. Flotation reagent conditions: the dosage of lime is 800 g/ton, and the pH value of ore pulp is 8.5. Other reagent conditions and results are as shown in table 5. The test results in table 5 show that the combined collector of azolethione compound with butyl xanthate obtains a higher copper, gold and silver flotation recoveries (rougher concentrates) than a common collector butyl xanthate as well as 3-hexyl-4-amino-1,2,4-triazole-5-thione+butyl xanthate.

TABLE 5

Conditions and results of flotation of porphyry copper ore in Shangrao, Jiangxi

| | | | Grade | | | Recovery ratio/% | | |
|---|---|---|---|---|---|---|---|---|
| Reagent type and dosage (g/t) | Product | Yield/% | Cu/% | Au* | Ag* | Cu | Au | Ag |
| Butyl xanthate 50, MIBC 20 | Rougher concentrates | 5.94 | 5.42 | 2.45 | 12.54 | 82.82 | 69.30 | 63.13 |
| | Tailings | 94.06 | 0.071 | — | | 17.18 | — | — |
| | Raw ores | 100.00 | 0.389 | 0.21 | 1.18 | 100.00 | 100.00 | 100.00 |
| Butyl xanthate 10, 3-hexyl-4-amino-1,2,4-triazole-5-thione 25, MIBC 10 | Rougher concentrates | 6.12 | 5.46 | 2.49 | 12.56 | 85.17 | 72.57 | 65.14 |
| | Tailings | 93.88 | 0.062 | — | | 14.83 | — | — |
| | Raw ores | 100.00 | 0.392 | 0.21 | 1.18 | 100.00 | 100.00 | 100.00 |
| Butyl xanthate 10, 5-heptyl-1,3,4-thiadiazole-2-thione 30, MIBC 15 | Rougher concentrates | 6.21 | 5.56 | 2.53 | 13.35 | 87.62 | 74.82 | 70.26 |
| | Tailings | 93.79 | 0.052 | — | | 12.38 | — | — |
| | Raw ores | 100.00 | 0.394 | 0.21 | 1.18 | 100.00 | 100.00 | 100.00 |
| Butyl xanthate 10, 5-pentyl-1,3,4-oxadiazole-2-thione 30, MIBC 15 | Rougher concentrates | 6.02 | 5.64 | 2.57 | 13.43 | 86.58 | 73.67 | 68.52 |
| | Tailings | 93.98 | 0.056 | — | | 13.42 | — | — |
| | Raw ores | 100.00 | 0.392 | 0.21 | 1.18 | 100.00 | 100.00 | 100.00 |
| Butyl xanthate 10, 5-heptyl-1,2,4-triazole-3-thione 25, MIBC 15 | Rougher concentrates | 5.73 | 6.05 | 2.76 | 13.77 | 88.24 | 75.31 | 66.87 |
| | Tailings | 94.27 | 0.049 | — | | 11.76 | — | — |
| | Raw ores | 100.00 | 0.393 | 0.21 | 1.18 | 100.00 | 100.00 | 100.00 |
| Butyl xanthate 10, 6-heptyl-1,2,4,5-tetrazole-3-thione 25, MIBC 10 | Rougher concentrates | 6.37 | 5.35 | 2.48 | 12.69 | 87.71 | 75.23 | 68.50 |
| | Tailings | 93.63 | 0.051 | — | | 12.29 | — | — |
| | Raw ores | 100.00 | 0.389 | 0.21 | 1.18 | 100.00 | 100.00 | 100.00 |

*Unit g/t

In conclusion, the flotation collector of the present invention can effectively increase the enrichment and recovery efficiency of valuable metal minerals from their ores containing at least one of copper minerals, silver minerals and gold minerals.

What is claimed is:

1. A method of using a flotation collector containing an azolethione structure, wherein the flotation collector with the azolethione compound having the structure as shown in formula 1 is applied for flotation separation of ores containing at least one of copper minerals, silver minerals and gold minerals as well as zinc minerals, lead minerals, nickel minerals, cobalt minerals, platinum minerals and palladium minerals to realize flotation recovery of valuable metal minerals, Formula 1

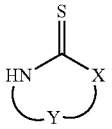

wherein X is NH, O or S, and Y is

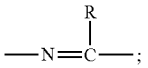

or,

X is NH, and Y is

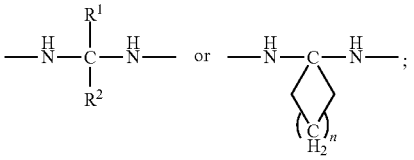

R is a $C_1$-$C_{17}$ hydrocarbyl group or an alkoxy ether group having the structure as shown in formula 2;

Formula 2

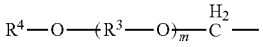

$R^1$ is a $C_1$-$C_{17}$ hydrocarbyl group; $R^2$ is H or a $C_1$-$C_3$ alkane group;

and n is an integer from 2 to 5;

wherein in formula 2, $R^4$ is a $C_1$-$C_{17}$ hydrocarbyl group, $R^3$ is an ethylidene group or a propylidene group, and m is 1-3.

2. The method of using the flotation collector containing the azolethione structure according to claim 1, wherein the flotation collector having the structure as shown in formula 1 has the structure as shown in formula 3, 4, 5 or 6:

Formula 3

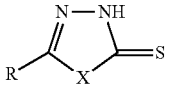

-continued

Formula 4

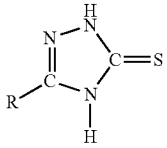

Formula 5

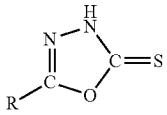

Formula 6

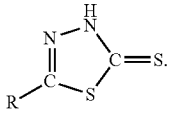

3. The method of using the flotation collector containing the azolethione structure according to claim 1, wherein R is a $C_1$-$C_{17}$ alkane group, or a $C_2$-$C_{17}$ olefinic group, or a $C_6$-$C_{12}$ aryl group.

4. The method of using the flotation collector containing the azolethione structure according to claim 2, wherein R is a $C_1$-$C_{17}$ alkane group, or a $C_2$-$C_{17}$ olefinic group, or a $C_6$-$C_{12}$ aryl group.

5. The method of using the flotation collector containing the azolethione structure according to claim 3, wherein R is a linear $C_1$-$C_{17}$ alkane group or a $C_{10}$-$C_{17}$ monoolefine group.

6. The method of using the flotation collector containing the azolethione structure according to claim 4, wherein R is a linear $C_1$-$C_{17}$ alkane group or a $C_{10}$-$C_{17}$ monoolefine group.

7. The method of using the flotation collector containing the azolethione structure according to claim 3, wherein R is propyl, pentyl, hexyl, heptyl, nonyl, n-hendecyl, n-tridecyl, n-pentadecyl, n-heptadecyl or 8-heptadecenyl.

8. The method of using the flotation collector containing the azolethione structure according to claim 4, wherein R is propyl, pentyl, hexyl, heptyl, nonyl, n-hendecyl, n-tridecyl, n-pentadecyl, n-heptadecyl or 8-heptadecenyl.

9. The method of using the flotation collector containing the azolethione structure according to claim 1, wherein in formula 2, $R^3$ is an ethylidene group.

10. The method of using the flotation collector containing the azolethione structure according to claim 1, wherein $R^4$ is a linear $C_1$-$C_{17}$ alkane group or a $C_{10}$-$C_{17}$ monoolefine group.

11. The method of using the flotation collector containing the azolethione structure according to claim 10, wherein in formula 2, $R^4$ is propyl, pentyl, hexyl, heptyl, nonyl, n-hendecyl, n-tridecyl, n-pentadecyl, n-heptadecyl or 8-heptadecenyl.

12. The method of using the flotation collector containing the azolethione structure according to claim 1, wherein the flotation collector is the 1,2,4,5-tetrazole-3-thione compound having the structure as shown in formula 7:

Formula 7

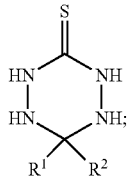

or the 1,2,4,5-tetrazole-3-thione compound having the structure as shown in formula 8:

Formula 8

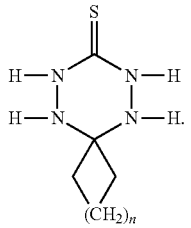

13. The method of using the flotation collector containing the azolethione structure according to claim 12, wherein $R^1$ is a $C_1$-$C_{17}$ alkane group, or a $C_2$-$C_{17}$ olefinic group, or a $C_6$-$C_{12}$ aryl group.

14. The method of using the flotation collector containing the azolethione structure according to claim 13, wherein $R^1$ is methyl, ethyl, n-propyl, n-butyl, n-pentyl, n-hexyl, n-heptyl, n-octyl, n-nonyl, n-decyl, n-hendecyl, n-dodecyl, n-tridecyl, n-tetradecyl, n-pentadecyl, n-hexadecyl or n-heptadecyl.

15. The method of using the flotation collector containing the azolethione structure according to claim 12, wherein $R^2$ is H, methyl, ethyl, propyl or isopropyl.

16. The method of using the flotation collector containing the azolethione structure according to claim 12, wherein $R^1$ is propyl, pentyl, hexyl, heptyl or nonyl, and $R^2$ is H or methyl.

17. The method of using the flotation collector containing the azolethione structure according to claim 12, wherein n in the compound having the structure as shown in formula 8 is 3.

18. The method of using the flotation collector containing the azolethione structure according to claim 1, comprising the following steps:

step (1): crushing, grinding and pulping the ore containing at least one of copper minerals, zinc minerals, lead minerals, nickel minerals, cobalt minerals, platinum minerals, palladium minerals, silver minerals and gold minerals to obtain ore pulp;

step (2): adding a flotation agent to the ore pulp obtained in step (1) for flotation, and collecting a flotation concentrate, wherein the flotation agent comprises the flotation collector.

19. The method of using the flotation collector containing the azolethione structure according to claim 2, comprising the following steps:

step (1): crushing, grinding and pulping the ore containing at least one of copper minerals, zinc minerals, lead minerals, nickel minerals, cobalt minerals, platinum minerals, palladium minerals, silver minerals and gold minerals to obtain ore pulp;

step (2): adding a flotation agent to the ore pulp obtained in step (1) for flotation, and collecting a flotation concentrate, wherein the flotation agent comprises the flotation collector.

20. The method of using the flotation collector containing the azolethione structure according to claim 13, wherein $R^2$ is H, methyl, ethyl, propyl or isopropyl.

* * * * *